US008205282B2

(12) United States Patent
Brogan et al.

(10) Patent No.: US 8,205,282 B2
(45) Date of Patent: Jun. 26, 2012

(54) PILLOW WITH AIR BLADDER INSERT

(75) Inventors: Ruth L. Brogan, Seattle, WA (US); Laura A. Regan, Bothell, WA (US)

(73) Assignee: Pacific Coast Feather Company, Seattle, WA (US)

( * ) Notice: Subject to any disclaimer, the term of this patent is extended or adjusted under 35 U.S.C. 154(b) by 0 days.

(21) Appl. No.: 12/855,982

(22) Filed: Aug. 13, 2010

(65) Prior Publication Data

US 2012/0036642 A1 Feb. 16, 2012

(51) Int. Cl.
*A47G 9/10* (2006.01)

(52) U.S. Cl. ..... 5/636; 5/644; 5/645

(58) Field of Classification Search ..... 5/709, 655.3, 5/636, 639, 640, 644, 645, 490, 491
See application file for complete search history.

(56) References Cited

U.S. PATENT DOCUMENTS

| | | | | | |
|---|---|---|---|---|---|
| 655,087 | A * | 7/1900 | Jones | ..... | 5/644 |
| 3,017,642 | A * | 1/1962 | Rosenberg et al. | ..... | 5/709 |
| 3,362,032 | A * | 1/1968 | Summers | ..... | 428/101 |
| 3,864,766 | A * | 2/1975 | Prete, Jr. | ..... | 5/644 |
| 4,501,034 | A * | 2/1985 | Greenawalt | ..... | 5/644 |
| 4,528,705 | A * | 7/1985 | Greenawalt | ..... | 5/644 |
| 4,908,894 | A * | 3/1990 | Sanders | ..... | 5/640 |
| 5,231,720 | A * | 8/1993 | Benoff | ..... | 5/644 |
| 6,047,425 | A * | 4/2000 | Khazaal | ..... | 5/644 |
| 6,691,352 | B2 * | 2/2004 | Wang | ..... | 5/636 |
| 7,051,389 | B2 * | 5/2006 | Wassilefky | ..... | 5/636 |
| 7,467,432 | B2 * | 12/2008 | Brogan | ..... | 5/636 |
| 7,832,034 | B2 * | 11/2010 | Liu et al. | ..... | 5/636 |

* cited by examiner

*Primary Examiner* — Michael Trettel
(74) *Attorney, Agent, or Firm* — Clark A. Puntigam; Jensen & Puntigam, P.S.

(57) ABSTRACT

The pillow includes a pillow tick which includes first and second substantially identical fabric members. A chamber extends along the length of the pillow at one longitudinal edge thereof. An air bladder member with crushable foam or polyester pellets is positioned within the chamber. A valve extends from the air bladder member to provide adjustable neck support. Pressure is exerted on the foam with the valve open. When the desired firmness is achieved, the valve is closed. Two baffle members are positioned in the tick volume between the other longitudinal edge of the tick and the chamber. The tick volume contains natural or synthetic fill. The baffles angle toward each other to provide good support and comfort and to reduce movement of the fill.

22 Claims, 3 Drawing Sheets

PILLOW WITH AIR BLADDER INSERT

TECHNICAL FIELD

This invention relates generally to pillows, and more particularly concerns a pillow with a neck support member.

BACKGROUND OF THE INVENTION

There are several important considerations in the design and construction of bed pillows. Two of the most important are comfort and support. This is true for both general purpose bed pillows, as well as special purpose and/or therapeutic pillows. Some pillows are designed to support the head of a user as well as providing specialized support for the neck region or some other portion of the head area. The pillow structure disclosed herein is particularly designed for general support of the head of the user as well as providing specialized support for the neck region.

In some pillows, in addition, it is important to have an adjustable capability for firmness for one or more portions of the pillow such as, for instance, the neck support section. Such an adjustable capability allows one pillow to be used for a variety of conditions. This can be done in various ways, including us of different inserts with different support characteristics, or an air inflatable member.

SUMMARY OF THE INVENTION

Accordingly, a pillow, in one arrangement, comprises: a pillow tick which includes first and second substantially identical fabric members; at least two baffle members positioned between and secured to the first and second sheet members, extending inwardly of the pillow tick from one longitudinal edge thereof toward the other longitudinal edge; a chamber extending substantially along the length of the pillow at the other longitudinal edge of the pillow tick; a natural or synthetic fill within the tick between the chamber and the one longitudinal edge; and a bladder member, containing crushable foam, positioned within the chamber, the bladder member including a valve assembly in fluid communication with the chamber which permits a variation in firmness when the valve is open by application of pressure to the crushable foam and then maintains a selected firmness when the valve is closed.

In another arrangement, the pillow comprises: a bladder member which includes a cover member and crushable foam in the interior thereof; a valve assembly in fluid communication with the interior of the bladder member, which permits a variation in firmness of the pillow when the valve is open by application of or release of pressure on the crushable foam and which maintains a selected firmness when the valve is closed; and a VE foam layer covering at least a portion of the bladder member.

BEST MODE FOR CARRYING OUT THE INVENTION

Figure 1:
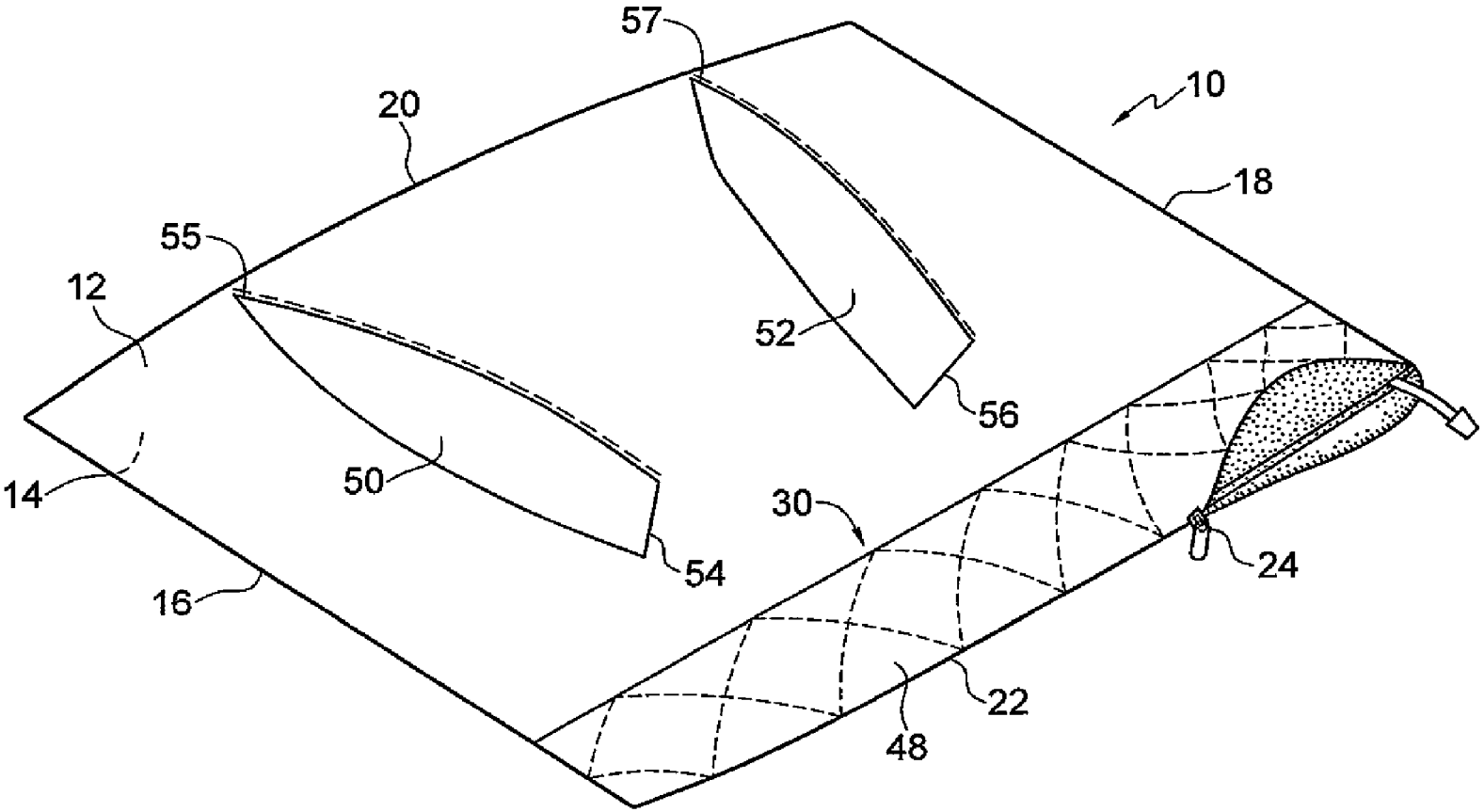
FIG. 1 is a perspective view of the pillow shown and described herein.
Figure 2:
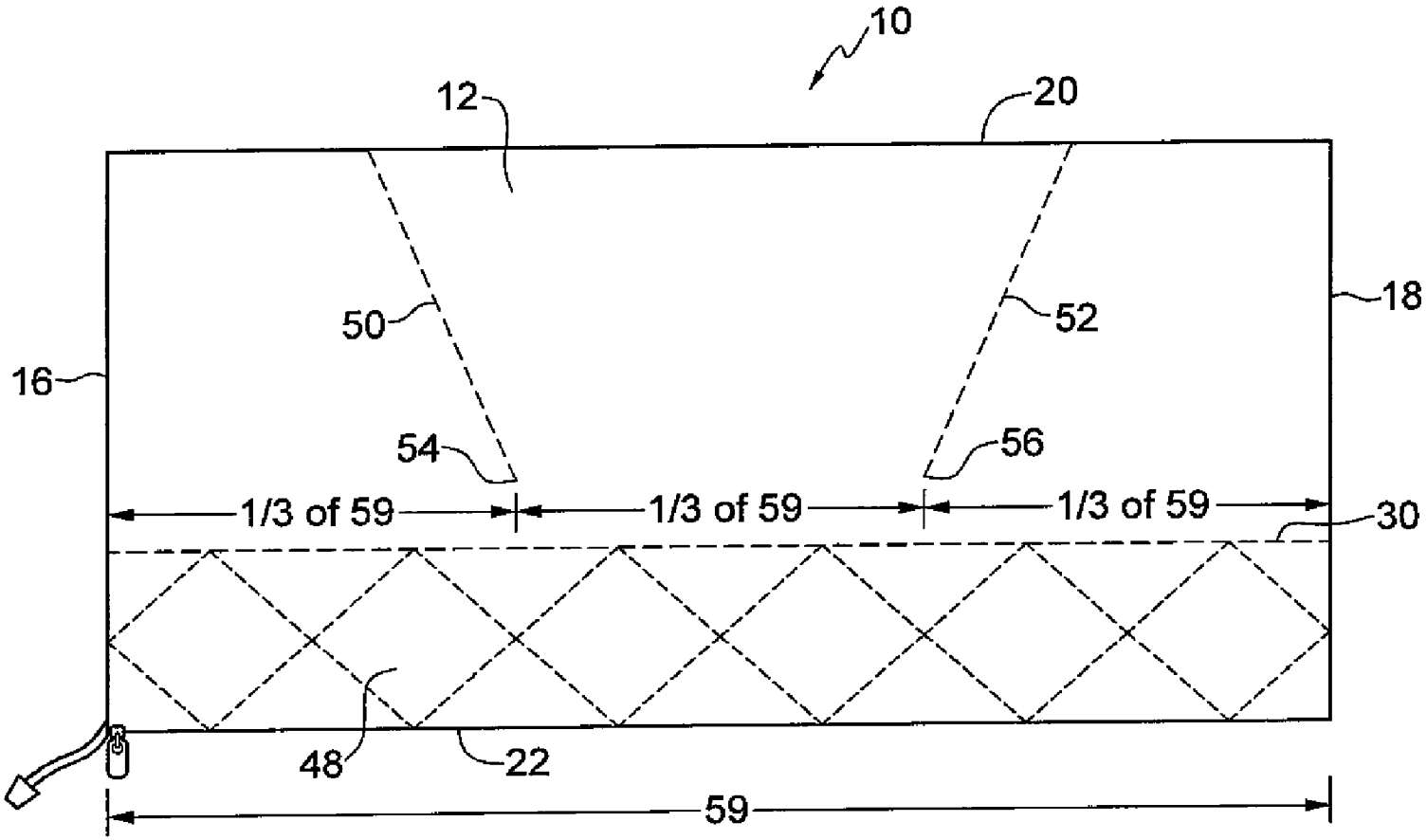
FIG. 2 is a top view of the pillow of FIG. 1.

FIGS. 1 and 2 show a pillow 10 which includes two identical fabric sheets 12 and 14 which comprise a pillow tick. The fabric sheets 12 and 14 are secured together or to an intermediate gusset along both end edges 16 and 18 and along one longitudinal edge 20. The other longitudinal edge 22 is openable by a zipper 24 or other similar closure element such as a Velcro closure or snaps. Other closure elements could be used. A compartment 48 is defined between longitudinal edge 22 and a compartment boundary line 30, established for instance by a line of stitching. Compartment 48 is quilted in the embodiment shown, lined with polyester batting, or other natural or synthetic material.

Two baffles 50 and 52 are positioned generally between compartment 48 and longitudinal edge 20. These baffles are secured to the upper and lower sheets 12 and 14, and in the embodiment shown extend from longitudinal edge 20 to a point slightly spaced apart from boundary line 30. In the embodiment shown, the free ends 54 and 56 of baffles 50 and 52 are located approximately 3 inches from boundary line 30, although this distance could be varied, such as within a range of 3-4 inches. The baffles 50 and 52 in the embodiment shown are each 6 inches long, although this could also vary, depending upon the actual size of the pillow. The pillow shown, with 6 inch baffles, is 20 inches long by 26 inches wide. The opposing ends 55 and 57 of the baffles adjacent longitudinal edge 22 are each approximately 5.5 inches from the end edges 16 and 18, respectively, of the pillow.

The baffles 50, 52 in the embodiment shown angle inwardly so that the free ends 54 and 56 of the baffles divide the pillow into three equal longitudinal segments, with one-third of the length 59 of the pillow being between end edge 16 and free end 54 of baffle 50, one-third of the length of the pillow being between the free ends 54 and 56 of baffles 50 and 52 and one-third of the length of the pillow being between free end 56 of baffle 52 and end edge 18. The baffles could alternatively extend straight across the pillow toward edge 20 from the position of free ends 54 and 56. The volume within the pillow between longitudinal edge 20 and boundary line 30 is filled with natural fibers, such as feathers or down, or synthetic fill. The two baffles 50 and 52 prevent the fill from shifting during use. Although baffles are part of the embodiment shown, they are not necessary and could be eliminated.

Positioned in compartment 48 is either a rectangular air bladder member or a bolster-type air bladder, each having somewhat different configurations. The rectangular air bladder 58 (FIG. 3) in the embodiment shown includes a vinyl or similar material bladder cover 59 and has a length dimension similar or substantially identical to the length of the pillow and a width of compartment 48, i.e. it has similar dimensions to compartment 48. The height of the bladder member 58 will vary, as discussed below. In one embodiment, the rectangular air bladder is wrapped with a layer 63 of viscoelastic (VE) or other polyurethane material. In the embodiment shown, the polyurethane layer is approximately 0.75 inch thick, although this could vary. Alternatively, the polyurethane layer could cover a portion of the air bladder, for instance one side of the bladder, or somewhat more or less than one side. Further, there could be no polyurethane layer at all.

A plurality of crushable polyurethane or similar foam or polyester pellets or pieces 62 are positioned within air bladder 58. A short hose or tubular member 64 extends from the interior of the air bladder 58, with the hose having a valve 66 on the end thereof. The hose/tubular member is not necessary, however, so that just a valve could be used. The rectangular air bladder 58 is self-inflating. If the foam or polyester pellets 62 are initially crushed, even partially, when the valve is opened, the pellets will thereafter inflate to full size. To adjust the firmness of the rectangular air bladder 58, when valve 66 is opened, air may be pushed out by the user by applying pressure to the foam or polyester pellets, crushing them to the point where the desired firmness provided by the foam or polyester is achieved. Valve 66 is then closed. The user thus has a fully adjustable neck support pillow, without the need to carefully inflate the pillow to achieve the desired firmness by air pressure alone. The final height of the bladder depends upon the amount of air present in the foam or polyester pellets. Although the embodiment shown uses pellets, larger chunks of foam or even a single foam piece can be used, or a small number of separate pieces of foam or polyester fiber.

Figure 4:
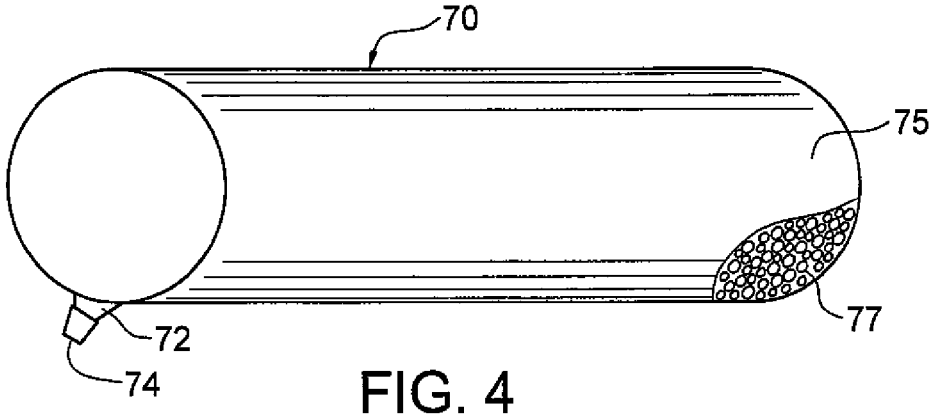
FIG. 4 is an elevational, partially cutaway, view of a bolster member insert for a portion of a pillow of FIGS. 1 and 2.

An alternative to rectangular air bladder 58 is a bolster air bladder 70, shown in FIG. 4. Bolster 70 is generally cylindrical and also includes a short hose 72 (or no hose) and a valve 74. The bolster includes a cover 75 and foam or polyester pellets or pieces 77. When valve 74 is opened, the foam or polyester pieces or piece therein expand to full size. Air can then be squeezed out by a user applying pressure on the foam or polyester pieces until the desired firmness is obtained. The valve 74 can then be closed. An exterior polyurethane layer can also be a part of bolster 70.

Figure 3:
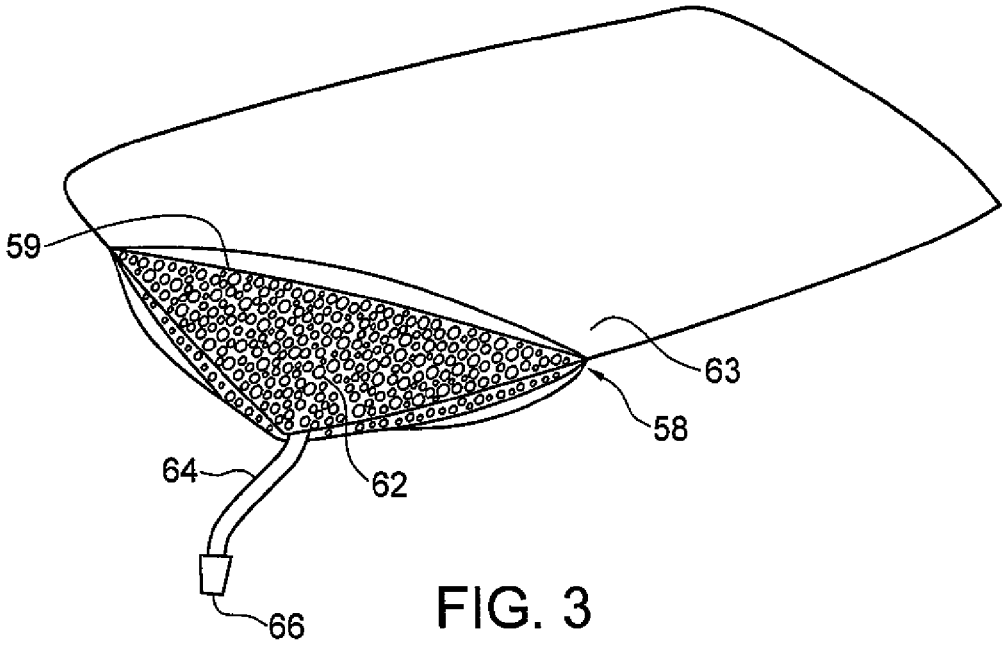
FIG. 3 is a perspective, partially cutaway, view of a bladder member insert for a portion of the pillow of FIGS. 1 and 2.
Figure 5:
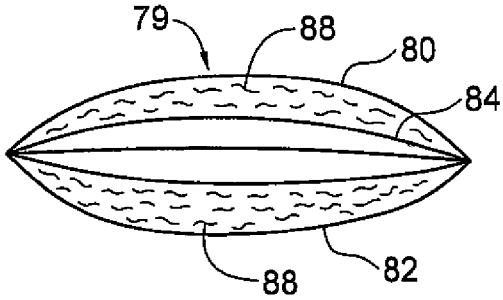
FIG. 5 is an end view of a pillow of FIGS. 1 and 2 or a pillow with the structure of FIG. 3 having outer layers to form a pillow-within-a pillow.

An alternative pillow is a polyurethane-encased air bladder similar to that of FIG. 3 in the shape of a full-size pillow. The pillow includes an air bladder similar to that shown in FIG. 3, with a vinyl cover defining a cavity into which is positioned foam or polyester pellets like that of FIG. 3, which generally range in size from 0.5-3 inches in diameter, preferably one inch. The air bladder pillow can have the desired full-size pillow dimensions, in twin, queen size, king size or other configurations, including 18×36 to fit inside a zip cover. Like FIG. 3, it has a tube (or not) connected to the interior of the pillow and a valve to provide the capability of adjusting the firmness of the entire pillow. The pillow includes a polyurethane foam layer in the form of a casing to provide the comfort associated with VE or other polyurethane material which conforms to the user due to its temperature characteristics, resulting in lower stiffness at elevated temperatures. Typically, the polyurethane foam layer will be approximately 0.75 inch. The polyurethane foam layer can cover a portion of the pillow, e.g. approximately one half of the pillow or the entire pillow FIG. 5 shows a pillow arrangement 79 with two outer layers 80, 82 stitched around the peripheries thereof to each other and to the edges of an inner pillow, referred to generally at 84, which could have the arrangement of FIGS. 1 and 2 or the arrangement of a full-size pillow similar to FIG. 3, as described above. There could also be a gusset around the periphery of the pillow. The volume between layers 80 and 82 and the inner pillow 84 can be filled at 88 with feathers, down, foam pieces or a combination thereof.

Accordingly, the above arrangement results in a pillow having one portion which provides a good combination of comfort and support for the head of a user, including elements to prevent movement of fill in that region within the pillow, as well as specialized support along the edge of the pillow which is adjustable for the neck region. Further, a pillow is disclosed having polyurethane foam pellets in the interior thereof and a polyurethane foam casing over a portion of or the entire pillow.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. A pillow, comprising:

a pillow tick which includes first and second substantially identical fabric members;

a chamber extending substantially along the length of the pillow at one longitudinal edge of the pillow tick;

a natural or synthetic fill within the tick between the chamber and the other longitudinal edge; and a bladder member, containing crushable foam, positioned within the chamber, the bladder member including a valve assembly in fluid communication with the chamber which permits a variation in firmness when the valve is open by application of pressure to the crushable foam and then maintains a selected firmness when the valve is closed.

2. The pillow claim 1, including at least two baffle members positioned between and secured to the first and second sheet members, extending inwardly of the pillow tick from one longitudinal edge thereof toward the other longitudinal edge.

3. The pillow of claim 1, including two outer fabric members enclosing the first and second fabric members and filling between the outer fabric members and the first and second fabric members.

4. The pillow of claim 1, wherein the baffle members extend to a point more than halfway toward the other longitudinal edge, but do not contact the chamber.

5. The pillow of claim 2, wherein the two baffle members angle toward each other or approximately parallel to each other as they extend from the one longitudinal edge.

6. The pillow of claim 4, wherein free ends of the baffle members are positioned to divide the length of the pillow into three equal sections.

7. The pillow of claim 1, wherein the chamber is quilted.

8. The system of claim 1, wherein the chamber is openable by a closure member.

9. The pillow of claim 6, wherein the closure member is a zipper.

10. The pillow of claim 1, wherein the bladder member is rectangular.

11. The pillow of claim 1, wherein the bladder is in the form of a bolster, approximately cylindrical in configuration.

12. The pillow of claim 10, wherein the crushable foam or polyester in the bladder is in the form of pellets.

13. The pillow of claim 1, wherein the valve assembly includes a tubular line extending from the interior of the bladder and in fluid communication therewith at a free end of the tubular line.

14. The pillow of claim 10, including a polyurethane foam layer covering at least a portion of the bladder member.

15. The pillow of claim 13, wherein the polyurethane foam layer covers all of the bladder member.

16. A pillow, comprising:

a bladder member which includes a cover member having slightly arcuate interior surfaces which extend from one edge to an opposing edge thereof and crushable foam or polyester member or members in the interior thereof;

a valve assembly in fluid communication with the interior of the bladder member, which permits a variation in firmness of the pillow when the valve is open by application of or release of pressure on the crushable foam or polyester and which maintains a selected firmness when the valve is closed; and a polyurethane foam layer adjacent to and covering at least a portion of the bladder member.

17. The pillow of claim 16, including two outer fabric members enclosing the bladder member and filling between the outer fabric layers and the bladder member.

18. The pillow of claim 17 wherein the polyurethane foam layer covers all of the bladder member.

19. The pillow of claim 16, wherein the bladder member is rectangular.

20. The pillow of claim 16, wherein the crushable foam or polyester is in the form of pellets.

21. The pillow of claim 16, wherein the valve assembly includes a tubular line extending from the interior of the bladder member and a valve element at a free end of the tubular line.

22. The pillow of claim 16, wherein the polyurethane foam layer is approximately 0.75 inches thick.

* * * * *